US008083363B2

(12) United States Patent
Jaster

(10) Patent No.: US 8,083,363 B2
(45) Date of Patent: Dec. 27, 2011

(54) DAYLIGHTING DEVICES AND METHODS WITH AUXILIARY LIGHTING FIXTURES

(75) Inventor: Paul August Jaster, Carlsbad, CA (US)

(73) Assignee: Solatube International, Inc., Vista, CA (US)

( * ) Notice: Subject to any disclaimer, the term of this patent is extended or adjusted under 35 U.S.C. 154(b) by 337 days.

(21) Appl. No.: 12/545,016

(22) Filed: Aug. 20, 2009

(65) Prior Publication Data

US 2011/0044041 A1 Feb. 24, 2011

(51) Int. Cl.
*F21V 9/02* (2006.01)

(52) U.S. Cl. ..... 362/1; 362/20; 362/558; 362/576; 362/150; 359/591

(58) Field of Classification Search ..... 362/1, 2, 362/20, 228, 576, 147, 148, 150, 404, 555, 362/557, 558; 52/200; 359/591, 597
See application file for complete search history.

(56) References Cited

U.S. PATENT DOCUMENTS

| | | | | |
|---|---|---|---|---|
| 668,404 | A * | 2/1901 | Hanneborg | 359/597 |
| 2,828,734 | A | 11/1958 | Boyd | |
| 4,018,211 | A | 4/1977 | Barr | |
| 4,114,186 | A | 9/1978 | Dominguez | |
| 4,126,379 | A | 11/1978 | Wu | |
| 4,334,524 | A | 6/1982 | McCullough et al. | |
| 4,539,625 | A | 9/1985 | Bornstein et al. | |
| 4,557,565 | A | 12/1985 | Ruck et al. | |
| 4,615,579 | A | 10/1986 | Whitehead | |
| 4,733,505 | A | 3/1988 | Van Dame | |
| 5,099,622 | A | 3/1992 | Sutton | |
| 5,117,811 | A | 6/1992 | Taylor | |
| 5,467,564 | A | 11/1995 | DeKeyser et al. | |
| 5,493,824 | A | 2/1996 | Webster et al. | |
| 5,528,471 | A | 6/1996 | Green | |
| 5,546,712 | A | 8/1996 | Bixby | |
| 5,648,873 | A | 7/1997 | Jaster et al. | |
| 5,655,339 | A | 8/1997 | Deblock et al. | |

(Continued)

FOREIGN PATENT DOCUMENTS

BE 1 014 530 12/2003

(Continued)

OTHER PUBLICATIONS

"3M Daylighting Film DF2000MA", Product Bulletin DF2000MA, Release A, Jun. 2006, 3M Graphics Market Center, St. Paul, MN.

(Continued)

*Primary Examiner* — Thomas Sember
(74) *Attorney, Agent, or Firm* — Knobbe Martens Olson & Bear LLP

(57) ABSTRACT

Daylighting systems and methods with auxiliary lighting fixtures are disclosed. Some embodiments disclosed herein provide a daylighting apparatus including a tube having a sidewall with a reflective interior surface and an auxiliary light fixture. The tube can be disposed between a transparent cover positioned to receive daylight and a diffuser positioned inside a target area of a building. In certain embodiments, the tube is configured to direct the daylight transmitted through the transparent cover towards the diffuser. The auxiliary light fixture can include a lamp disposed within the tube and a light control surface configured to reflect light exiting the lamp towards the diffuser and to transmit daylight propagating through the tube from the direction of the transparent cover. The lamp can be disposed on the sidewall of the tube.

19 Claims, 5 Drawing Sheets

U.S. PATENT DOCUMENTS

| | | | | |
|---|---|---|---|---|
| 5,729,387 | A | 3/1998 | Takahashi et al. | |
| 5,735,262 | A | 4/1998 | Houtman | |
| 5,878,539 | A | 3/1999 | Grubb | |
| 5,896,712 | A | 4/1999 | Chao | |
| 5,896,713 | A | 4/1999 | Chao et al. | |
| 5,897,201 | A | 4/1999 | Simon | |
| 5,999,323 | A | 12/1999 | Wood | |
| 6,000,170 | A | 12/1999 | Davis | |
| RE36,496 | E | 1/2000 | Sutton | |
| 6,035,593 | A | 3/2000 | Chao et al. | |
| 6,130,781 | A | 10/2000 | Gauvin | |
| 6,142,645 | A | 11/2000 | Han | |
| 6,219,977 | B1 | 4/2001 | Chao et al. | |
| 6,256,947 | B1 | 7/2001 | Grubb | |
| 6,321,493 | B1 | 11/2001 | Rillie et al. | |
| 6,363,667 | B2 | 4/2002 | O'Neill | |
| 6,363,668 | B2 | 4/2002 | Rillie et al. | |
| 6,412,238 | B2 | 7/2002 | Rillie et al. | |
| 6,415,563 | B2 | 7/2002 | Rillie | |
| 6,438,803 | B2 | 8/2002 | Rillie et al. | |
| 6,493,145 | B1 | 12/2002 | Aoki et al. | |
| 6,502,950 | B2 | 1/2003 | Signer | |
| 6,604,329 | B2 | 8/2003 | Hoy et al. | |
| 6,623,137 | B1 | 9/2003 | Marsonette | |
| 6,655,814 | B1 | 12/2003 | Tagawa et al. | |
| 6,699,558 | B1 | 3/2004 | Milburn | |
| 6,827,445 | B2 | 12/2004 | Abe et al. | |
| 6,840,645 | B2 | 1/2005 | Eisenman et al. | |
| 6,870,673 | B2 | 3/2005 | Cromer et al. | |
| 7,040,061 | B2 | 5/2006 | Rillie et al. | |
| 7,057,821 | B2 | 6/2006 | Zincone | |
| 7,082,726 | B2 | 8/2006 | Prenn et al. | |
| 7,146,768 | B2 | 12/2006 | Rillie | |
| 7,159,364 | B2 | 1/2007 | Rillie | |
| 7,168,211 | B2 | 1/2007 | Prenn et al. | |
| 7,222,461 | B2 | 5/2007 | Piano et al. | |
| 7,322,156 | B1 | 1/2008 | Rillie et al. | |
| 7,395,636 | B2 | 7/2008 | Blomberg | |
| 7,546,709 | B2 | 6/2009 | Jaster et al. | |
| 7,639,423 | B2 | 12/2009 | Kinney et al. | |
| 7,670,021 | B2 * | 3/2010 | Chou | 362/148 |
| 7,736,014 | B2 | 6/2010 | Blomberg | |
| 7,757,444 | B1 | 7/2010 | Halliday | |
| 2001/0049915 | A1 | 12/2001 | Rillie et al. | |
| 2001/0049916 | A1 | 12/2001 | Rillie et al. | |
| 2001/0052208 | A1 | 12/2001 | Rillie et al. | |
| 2001/0052209 | A1 | 12/2001 | Rillie et al. | |
| 2002/0051297 | A1 | 5/2002 | Hoy et al. | |
| 2002/0060283 | A1 | 5/2002 | Jordan et al. | |
| 2002/0073635 | A1 | 6/2002 | Erskine | |
| 2002/0085393 | A1 | 7/2002 | Eisenman et al. | |
| 2004/0050380 | A1 | 3/2004 | Abe | |
| 2005/0005542 | A1 | 1/2005 | Prenn et al. | |
| 2005/0039789 | A1 | 2/2005 | Kim | |
| 2005/0128728 | A1 | 6/2005 | Eisenman et al. | |
| 2005/0188629 | A1 | 9/2005 | Rillie et al. | |
| 2005/0243430 | A1 | 11/2005 | Cuttle | |
| 2005/0252111 | A1 | 11/2005 | Prenn et al. | |
| 2006/0007549 | A1 | 1/2006 | Zincone | |
| 2007/0035841 | A1 | 2/2007 | Kinney et al. | |
| 2007/0163732 | A1 | 7/2007 | Konstantin et al. | |
| 2007/0271848 | A1 | 11/2007 | Wolf et al. | |
| 2010/0309556 | A1 | 12/2010 | Jaster | |

FOREIGN PATENT DOCUMENTS

| | | |
|---|---|---|
| CA | 2337293 | 8/2002 |
| JP | 60142413 | 9/1985 |
| JP | 60164704 | 11/1985 |
| JP | 60166906 | 11/1995 |
| WO | WO 2006/028703 | 3/2006 |
| WO | WO2010/070169 | 6/2010 |

OTHER PUBLICATIONS

Ge et al., "Heat Loss Calculation of Compound Honeycomb Solar Collection"; Journal of Thermal Science, vol. 2, No. 4, pp. 254-259, Oct. 1993.

Kaushika et al., "Solar Transparent Insulation Materials: A Review"; Renewable and Sustainable Energy Reviews, vol. 7, pp. 317-351, 2003.

International Search Report and Written Opinion for PCT Application No. PCT/US2010/045215, dated Dec. 6, 2010.

Sunflower Corporation, "Sustainable Commercial Daylighting Technical Overview", Dec. 11, 2009.

Invitation to Pay Additional Fees and Communcation relating to the results of the Partial International Search for PCT Application No. PCT/US2010/045215, dated Oct. 14, 2010.

"LED Light add on Kit for skylight tubes," Wild Ideas Light Company Ltd., published at least as early as Apr. 2009.

"2301 Optical Lighting Film" Technical Specification, Effective Date: Feb. 1, 2000, 3M Specified Construction Products Department, http://www.mmm.com/office.

* cited by examiner

FIG. 5
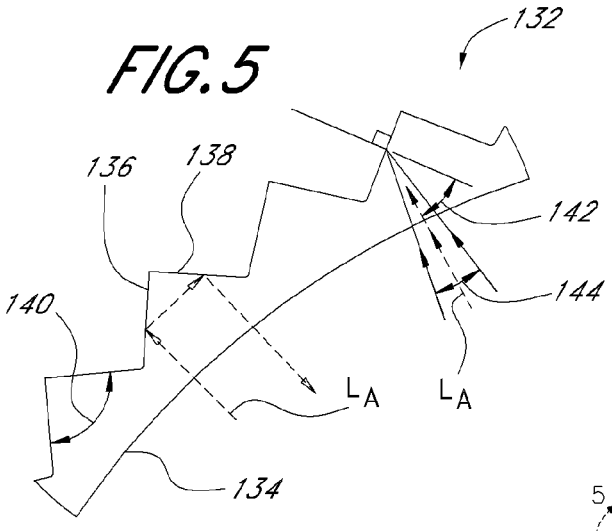
FIG. 6
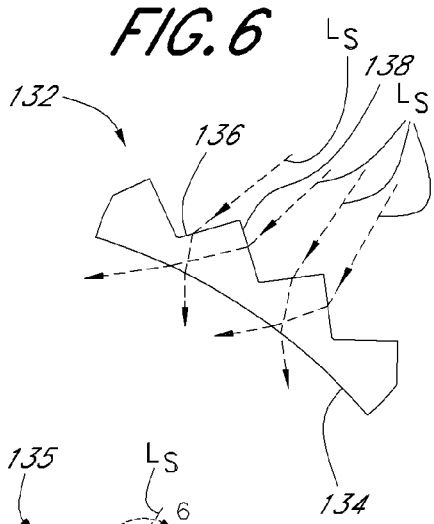
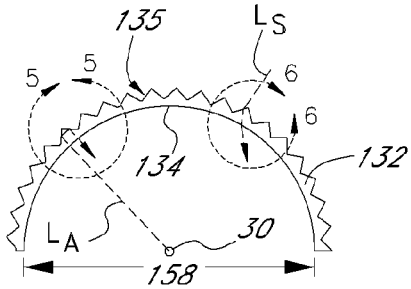
FIG. 4
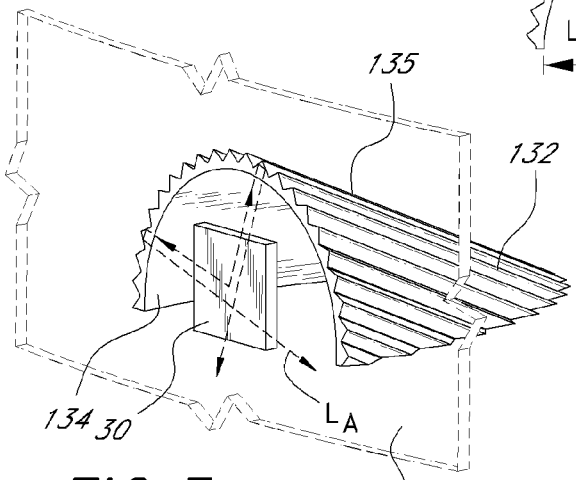
FIG. 3
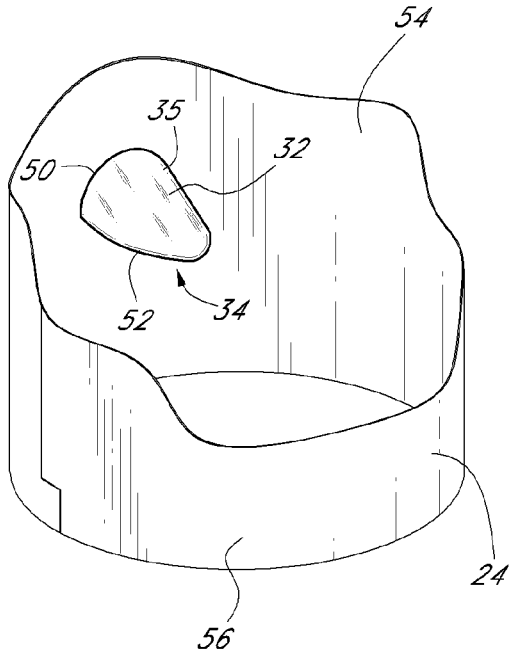
FIG. 2

DAYLIGHTING DEVICES AND METHODS WITH AUXILIARY LIGHTING FIXTURES

BACKGROUND

1. Field

This disclosure relates generally to daylighting systems and methods and more particularly to daylighting systems and methods with auxiliary lighting fixtures.

2. Description of Related Art

Daylighting systems typically include windows, openings, and/or surfaces that provide natural light to the interior of a structure. Examples of daylighting systems include skylight and tubular daylighting device (TDD) installations. In a TDD installation, a transparent cover can be mounted on a roof of a building or in another suitable location. An internally reflective tube can connect the cover to a diffuser mounted in a room to be illuminated. The diffuser can be installed in the ceiling of the room or in another suitable location. Natural light entering the cover on the roof can propagate through the tube and reach the diffuser, which disperses the natural light throughout the interior of the structure.

SUMMARY

Some embodiments disclosed herein provide a daylighting apparatus including a tube having a sidewall with a reflective interior surface. The tube can be disposed between a transparent cover positioned to receive daylight and a diffuser positioned inside a target area of a building. The tube can be configured to direct the daylight transmitted through the transparent cover towards the diffuser. An auxiliary light fixture can be disposed within the tube and can include a lamp configured to illuminate inside the tube. In some embodiments, the lamp can be configured to emit a cone of light and can be positioned such that light exiting the lamp along the angular center of the cone of light propagates such that the light is incident on a surface other than the diffuser before propagating to the diffuser.

In certain embodiments, the lamp is a surface-mount light-emitting diode having a planar surface from which a cone of light is emitted. The planar surface of the lamp can be substantially parallel to the sidewall of the tube.

The auxiliary light fixture can include a light control surface extending from the sidewall of the tube and can be configured to redirect at least a portion of light emanating from the lamp towards the diffuser. The light control surface can include a reflector or a prismatic film configured to reflect the light exiting the lamp and to transmit daylight propagating through the tube from the direction of the transparent cover. In some embodiments, the shape of the light control surface can be generally half-cylindrical. The light control surface can include a top edge and a base perimeter, the top edge abutting the sidewall of the tube and the base perimeter being substantially coplanar with a lower edge of the lamp. The light control surface can be positioned such that a radius point of the light control surface is approximately at a base of the lamp. The light control surface can be tilted at an angle away from a perpendicular orientation with respect to the sidewall. The angle between the light control surface and the perpendicular orientation can be at least about 20 degrees.

In some embodiments, a daylighting apparatus includes a tube having a sidewall with a reflective interior surface, the tube being disposed between a transparent cover positioned to receive daylight and a diffuser positioned inside a target area of a building. The tube can be configured to direct the daylight transmitted through the transparent cover towards the diffuser, and the tube can include an auxiliary light fixture. The auxiliary light fixture can include a lamp disposed within the tube; and a light control surface configured to reflect light exiting the lamp towards the diffuser and to transmit daylight propagating through the tube from the direction of the transparent cover. The lamp can be connected to the sidewall of the tube. In some embodiments, thermal grease is disposed between the lamp and the sidewall.

A base perimeter of the light control surface can be substantially coplanar with a lower edge of the lamp. The auxiliary light fixture can include a light-emitting diode or a plurality of light-emitting diodes. Similarly, the auxiliary light fixture can includes a light control surface or a plurality of light control surfaces.

The light control surface can include a polymer film such as polycarbonate and/or a turning microstructure disposed on a side of the surface closest to the transparent cover. In some embodiments, the turning microstructure can include a plurality of elongate prisms extending from the sidewall to a base perimeter of the light control surface.

In some embodiments, a method of providing light inside of a structure can include the steps of positioning a tube between a transparent cover and a diffuser in a manner that permits daylight to be directed from the cover through the diffuser; providing an auxiliary light source that emits light to a region inside of the tube; and providing a light control surface near the auxiliary light source that reflects light exiting the lamp towards the diffuser and transmits daylight from the transparent cover in the general direction of the diffuser.

In some embodiments, a method of lighting an interior of a building can include the steps of permitting daylight to pass from a transparent cover through a tube to a diffuser inside of the building; emitting light from an auxiliary light source to a region within the tube; and reflecting light from the auxiliary light source off of a light control surface toward the diffuser and simultaneously or at a different time permitting daylight to pass through the light control surface.

BRIEF DESCRIPTION OF THE DRAWINGS

Various embodiments are depicted in the accompanying drawings for illustrative purposes, and should in no way be interpreted as limiting the scope of the inventions. In addition, various features of different disclosed embodiments can be combined to form additional embodiments, which are part of this disclosure. Throughout the drawings, reference numbers may be reused to indicate correspondence between reference elements.

FIG. 2 is a perspective view of a tube with a light control surface attached thereto.

FIG. 3 is a perspective view of an auxiliary lighting fixture connected to a tube.

FIG. 4 is a cross-sectional view of the auxiliary lighting fixture shown in FIG. 3.

FIG. 5 is a partial cross-sectional view of the prismatic film of the auxiliary lighting fixture shown in FIG. 4.

FIG. 6 is another partial cross-sectional view of the prismatic film of the auxiliary lighting fixture shown in FIG. 4.

DETAILED DESCRIPTION OF PREFERRED EMBODIMENTS

Figure 1:
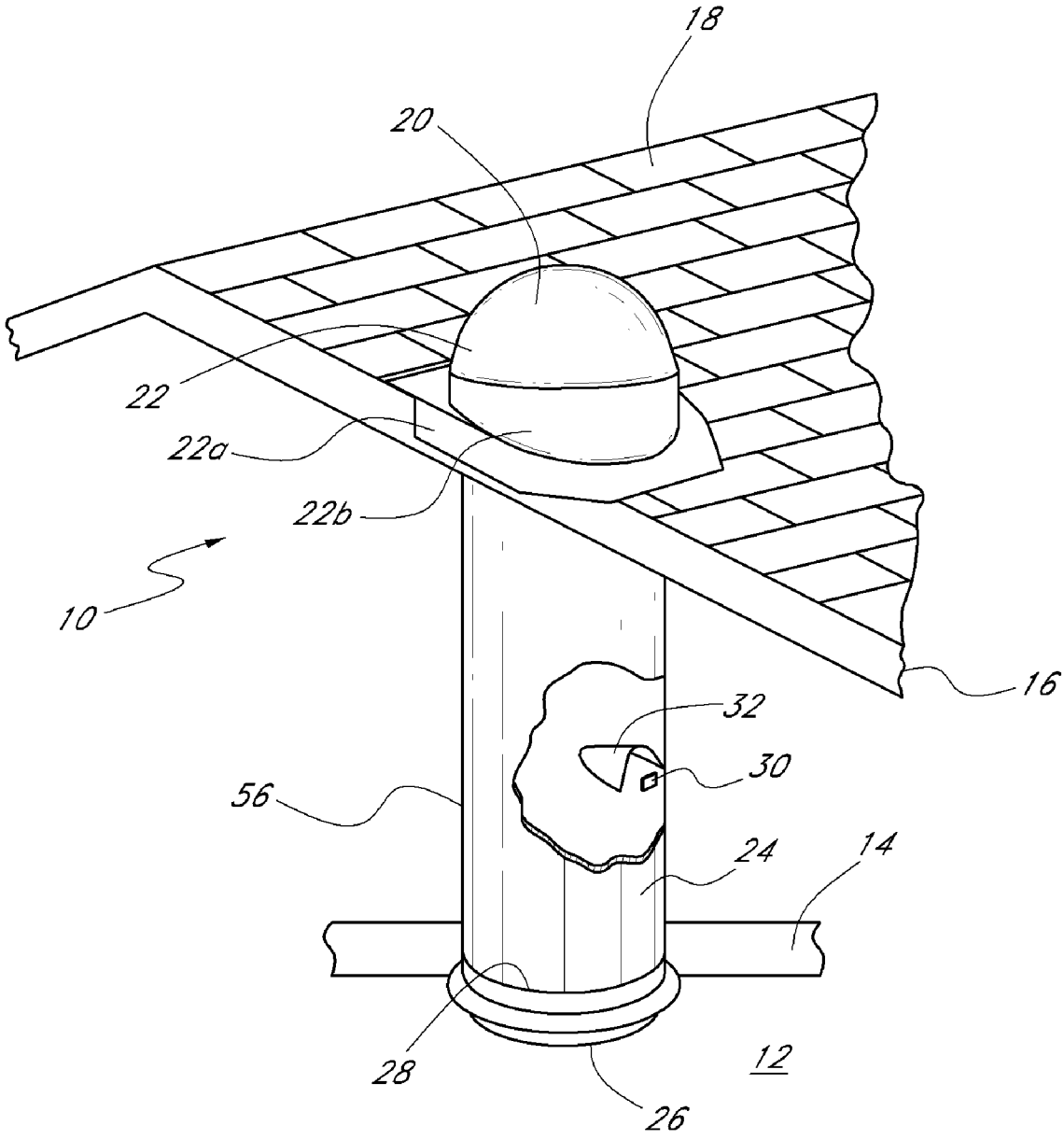
FIG. 1 is a cutaway illustration of a TDD installation.

In some embodiments, TDD installations can include a transparent dome enclosure on the roof of a building structure, a generally vertical reflective tube extending from the dome enclosure, and a diffuser disposed at the opposite end of the reflective tube. The dome allows exterior light, such as natural light, to enter the system. The tube transfers the exterior light down to the diffuser, which disperses the light around a targeted room or area in the interior of a building. A TDD installation can sometimes also be referred to as a "tubular skylight."

An auxiliary lighting system can be installed in a TDD to provide light from the tube to the targeted area when sunlight is not available in sufficient quantity to provide a desired level of interior lighting. In some embodiments, TDDs in which the lighting fixture is suspended from a rod or wire may suffer from various drawbacks. For example, the rod, or other apparatus for supporting the lamp, and the lamp itself may occupy a substantial portion of the tube interior, thereby reducing the performance of the tubular skylight. If a lighting apparatus is attached to a fixture such as a rod or wire in the center of the tube, and especially if the lighting apparatus has a heat exchanger attached to its back side, a large amount of daylight can be blocked from continuing down the tube. At least a portion of the rod, wire, heat exchanger, other structures of the lighting fixture, or a combination of structures can be transparent or translucent in order to at least partially mitigate blockage of daylight.

In some cases, a conventional lighting apparatus typically illuminates in a pattern that allows nearly half of the generated light to be lost back up the tube. Moreover, in some cases, only a portion of the light from the lamp enters the tube base diffuser at an incident angle that provides high transmission efficiencies. When the incident angle of light on the diffuser is high, a greater portion of light can be reflected back up the tube by the diffuser. This effect, together with the light lost up the tube due to the illumination pattern of the lamp, can result in a substantial portion of light from the lamp not reaching the targeted area. Also, if the lighting apparatus is facing towards the diffuser, it can create a very bright spot of light that may require further diffusion to eliminate glare and reduce contrast.

Some embodiments disclosed herein provide a daylighting apparatus including a tube having a sidewall with a reflective interior surface and an auxiliary light fixture. The tube can be disposed between a transparent cover positioned to receive daylight and a diffuser positioned inside a target area of a structure such as a building. In certain embodiments, the tube is configured to direct the daylight transmitted through the transparent cover towards the diffuser. The auxiliary light fixture can include a lamp disposed within the tube and a light control surface configured to reflect light exiting the lamp towards the diffuser and to transmit daylight propagating through the tube from the direction of the transparent cover. The lamp can be disposed on the interior sidewall of the tube or on another surface or structure in a way that permits light generated by the lamp to pass into the interior of the tube.

FIG. 1 shows a cutaway view of an example of a tubular skylight 10 installed in a building for illuminating, with natural light, an interior room 12 of a building 16. The tubular skylight 10 includes a transparent cover 20 mounted on a roof 18 of the building 16 that allows natural light to enter a tube 24. The cover 20 can be mounted to the roof 18 using a flashing 22. The flashing 22 can include a flange 22*a* that is attached to the roof 18, and a curb 22*b* that rises upwardly from the flange 22*a* and is angled as appropriate for the cant of the roof 18 to engage and hold the cover 20 in a generally vertically upright orientation.

The tube 24 can be connected to the flashing 22 and can extend from the roof 18 through a ceiling 14 of the interior room 12. The tube 24 can direct light that enters the tube 24 downwardly to a light diffuser 26, which disperses the light in the room 12. The inside of the tube 24 can be reflective. The tube 24 can be made of metal, fiber, plastic, a rigid material, an alloy, another appropriate material, or a combination of materials. For example, the body the tube 24 can be constructed from type 1150 alloy aluminum.

The tube 24 can terminate at a light diffuser 26. The light diffuser 26 can include one or more devices that spread out or scatter light in a suitable manner. In some embodiments, the diffuser 26 absorbs relatively little or no visible light and transmits most or all incident visible light, at least at certain angles of incidence. The diffuser can include one or more lenses, ground glass, holographic diffusers, or any other suitable diffusers. The diffuser 26 can be connected to the tube 24 using any suitable connection technique. For example, a seal ring 28 can be surroundingly engaged with the tube 24 and connected to the light diffuser 26 to hold the diffuser 26 onto the end of the tube 24.

An auxiliary light source 30 can be disposed inside the tube 24. In certain embodiments, the light source 30 can be attached to an interior or exterior side wall of the tube 24 in a generally vertical orientation, as shown in FIG. 1, for example. In some embodiments, the light source 30 can be disposed in another suitable position, including behind or in front of the side wall of the tube 24. For example, the light source 30 can be connected to a projection extending from the side wall into the interior of the tube 24. As another example, the light source 30 can be positioned in a recess that extends from the side wall outward from the interior of the tube 24.

A light control surface 32 can be disposed adjacent to the light source 30 and can at least partially surround the light source 30. The light control surface 32 can also be attached to the side wall of the tube 24 on the side of the light source 30 closest to the cover 20. The light control surface 32 is configured to direct light emanating upwardly from the light source 30 in a downward direction towards the diffuser 26. Without the light control surface 32, a portion of the directed light would propagate up the tube 24 in the direction of the cover 20 and exit the tube 24 into the exterior environment. Thus, the light control surface 32 can increase luminous intensity at the diffuser 26 while the luminosity of the auxiliary light source 30 is held constant. The light control surface 32 can also increase the collimation of light incident on the diffuser 26. In certain instances, the optical efficiency of the diffuser 26 is increased when incident light is more nearly collimated.

FIG. 2 shows a perspective view of a tube 24 to which a light control surface 32 is attached. The light control surface 32 may also be referred to as a "light control awning" or a "light control film." The tube 24 is generally configured to direct natural light from the cover 20 (FIG. 1) to the diffuser 26 and to direct auxiliary light from the light source 30 to the diffuser 26 with minimal absorption or loss of visible light.

An interior surface 54 of the tube 24 can be made reflective by any suitable technique, including, for example, electroplating, anodizing, coating, or covering the surface 54 with a reflective film. Reflective films can be highly reflective in at least the visible spectrum and include metallic films, metalized plastic films, multi-layer reflective films, or any other structure that reflects the majority of light in the visible spectrum. In some embodiments, the interior surface 54 is specular. The interior surface 54 may be configured to reflect, transmit, or absorb light outside the visible spectrum in order to achieve certain performance characteristics. For example, the interior surface 54 may be configured to transmit infrared light to improve the thermal characteristics of the tube 24. A material system or layer (not shown) beneath the reflective surface 54 may be configured to strongly absorb infrared light or other radiation that is transmitted through the interior surface 54. An absorptive film, coating, paint, or other material can be used for this purpose.

An exterior surface 56 of the tube 24 may be exposed to a space between the roof 18 of the building 16 and the diffuser 26. For example, when the diffuser 26 is mounted adjacent to a ceiling 14 of a room 12 to be illuminated, the exterior surface 56 may be exposed to an attic of the building 16 or a pipe chase. The exterior surface 56 may expose the material from which the tube 24 is made or may have a covering that increases performance characteristics of the tube 24. For example, the exterior surface 56 may be covered with a coating or film that aids in the dissipation of heat. In certain embodiments, a high emissivity film is disposed on the exterior surface 56 of the tube 24.

In the embodiment illustrated in FIG. 2, the light control surface 32 extends from the interior surface 54 of the tube 24. The light control surface 32 can be integral with the interior surface 54 or can be a separate material that is connected to the tube 24. Any suitable connection technique can be used, including, for example, fastening, adhering, bonding, friction fitting, welding, gluing, or socketing the light control surface 32 to the tube 24. The light control surface 32 can have a top face 35 that faces the transparent cover 20 and a bottom face 34 that faces the diffuser 26. In some embodiments, the light control surface 32 includes a material of substantially uniform thickness and is curved such that the top face 35 is convex and the bottom face 34 is concave. A tube edge 50 of the light control surface 32 abuts the interior surface 54 of the tube 24 while a peripheral edge 52 of the light control surface 32 extends into the interior volume of the tube 24. The light control surface 32 can be configured such that the amount of natural light incident on the top face 35 is decreased or minimized while the amount of auxiliary light reflected by the bottom face 34 is increased or maximized. The light control surface 32 can be configured such that the luminous intensity at the diffuser 26 is generally increased or maximized, accounting for natural light, auxiliary light, and a combination of natural light and auxiliary light.

The light control surface 32 is configured to direct visible light emanating from the auxiliary light source 30 towards the diffuser 26. The light control surface 32 can be constructed from any suitable material that directs light in this manner, including, for example, a metal, a metalized plastic film, a reflective film, a plastic film with light turning features, or a combination of materials. A reflector above and around the light source can capture light that is directed up the tube and redirect it back down the tube. While the use of a reflector can reduce light loss from the auxiliary lighting fixture, sunlight reflecting down the tube can be at least partially blocked by the reflector when certain materials are used.

FIG. 3 illustrates an auxiliary light fixture connected to the tube 24. The auxiliary light fixture includes a light source 30 and a prismatic film 132. The light source can include any suitable lighting apparatus (generally referred to herein as a "lamp") such as, for example, an incandescent light bulb, a fluorescent light bulb, an electromagnetic induction lamp, a high-intensity discharge lamp, a gas discharge lamp, an electric arc lamp, a light-emitting diode (LED), a solid-state lighting apparatus, an electroluminescent apparatus, a chemiluminescent apparatus, a radioluminescent apparatus, a light fidelity lamp, a plurality of lamps, or a combination of lighting apparatus. In some embodiments, a lighting apparatus can be selected to achieve one or more of the following goals: high performance to power required ratio, reduced costs, and compactness. In some embodiments, the light source 30 includes a surface-mount LED such as one available from Cree, Inc. of Durham, N.C.

In the example shown in FIG. 3, the light source 30 is flat, thin (e.g., less than or equal to about ⅛" thick) and occupies an area of approximately 0.75" by 0.75". Light sources having many other dimensions and/or geometries can also be used. Light can be emitted from the front surface of the light source 30 in a cone. In some embodiments, the cone of emitted light can include a vertex angle equal to or greater than about 60 degrees and/or less than or equal to about 120 degrees, depending on the particular lighting apparatus used. Certain types of lighting apparatus, including LEDs, generate substantial waste heat in addition to the desired output. A heat sink or heat exchanger in thermal communication with the lighting apparatus can be used to remove waste heat. Removing waste heat can improve the efficiency and lifespan of an LED and other types of lighting apparatus. The heat sink can be attached to the back of the lighting apparatus, improving the transfer of heat from the lighting apparatus to the external environment via conduction, convection, and/or radiation.

Figure 9:
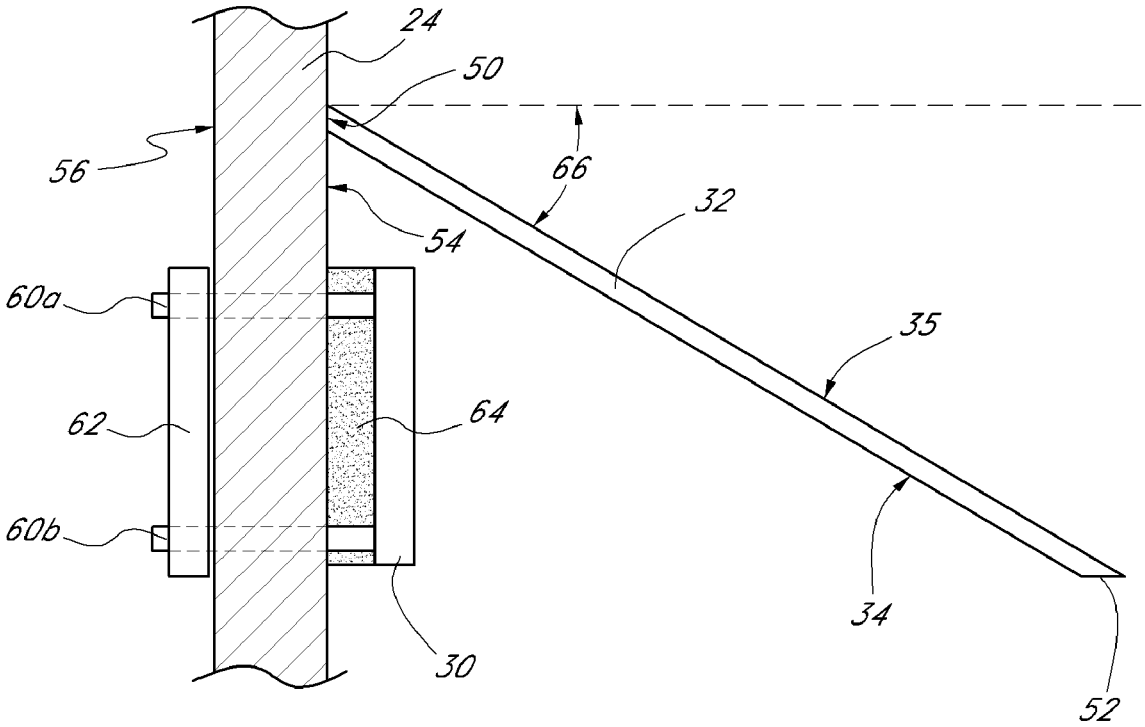
FIG. 9 is a cross-sectional view of an auxiliary lighting fixture connected to a TDD.

Referring to FIG. 9, thermal heat exchange grease 64 can be applied between the light source 30 and the wall of the tube 24 in order to facilitate removal of waste heat. The tube 24 can provide a structure for holding the light source 30 in place. For example, fasteners 60*a*-60*b* can be used to connect the light source 30 to the sidewall of the tube 24. The light source 30 can be connected to the sidewall in other ways, such as, for example, with an adhesive. The fasteners 60*a*-60*b* can be inserted through a back plate 62, a nut, or another suitable structure disposed on the outside surface 56 of the tube 24 in order to strengthen the connection between the light source 30 and the sidewall. In some embodiments, the light source 30 is tightly engaged with the inside surface 54 of the tube 24 in order to increase thermal conductivity between the light source 30 and the tube 24. The conductivity and thickness of the tube 24 can facilitate conduction of heat away from the light source 30 to the large area of the tube 24, which can act as a heat sink for the light source 30. The tube 24 radiates the heat outside and inside of the tube 24 based on the emissivity of the exterior surface 56 and the interior surface 54 of the tube 24. The light source 30 can be connected to a power source (not shown) via wires and/or electrical connectors.

In some embodiments, the placement of the light source 30 on or near a sidewall of the tube 24 can minimize or decrease blockage of sunlight traveling down the tube when compared to a placement of the light source 30 in the center of the tube 24 or facing downward. The placement can also provide an economical structure for removing heat and supporting the light source 30. In some embodiments, the front light emitting surface of the light source 30 faces the inside area of the tube and is in an orientation generally parallel to the longitudinal axis of the tube. In certain other embodiments, the light source 30 is tilted at an angle with respect to the axis of the tube. For example, the light source 30 can be tilted toward the diffuser or face the diffuser. In some embodiments, without a light control surface, up to 50% of light output by the light source 30 can go up the tube 24 and be wasted, while the remainder would go down to the diffuser 26 at various incident angles.

Figure 10:
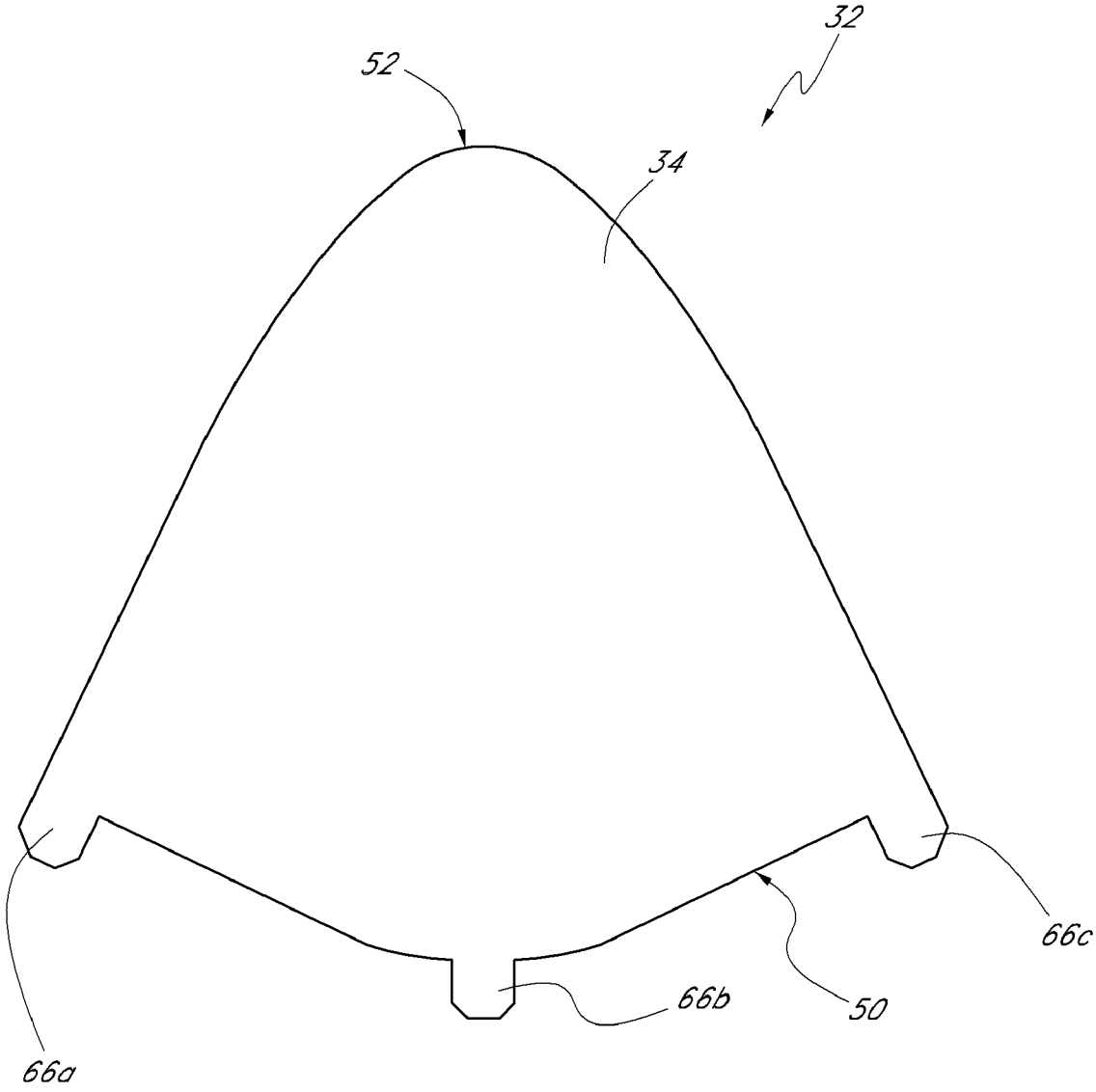
FIG. 10 is a top view of an example of an unbent light control surface.

The light control surface 32 will now be discussed with reference to FIGS. 2, 9, and 10. In some embodiments, the light control surface 32 is generally curved when positioned within the tube 24, but can be cut from or molded in a generally flat sheet and then bent or folded into a desired shape. An example of an unfolded top view of the light control surface 32 is shown in FIG. 10. The light control surface 32 can be connected to the tube 24 by adhering the top edge 50 of the surface 32 to the tube 24, by friction fitting the surface 32 into a slot (not shown) in the tube 24, by adhering or friction fitting one or more tabs 66*a*-66*c* extending from the top edge 50 of the surface 32 to the tube 24, or by any other suitable technique. In some embodiments, the tabs 66*a*-66*c* are positioned at least at the boundaries between the top edge 50 and the base perimeter 52 and at a middle point along the top edge 50. As illustrated, the light control surface 32 can be positioned near the light source 30. In some embodiments, the light control surface 32 can generally surround an upper region of the light source 30 as shown.

As installed in the tube 24, the light control surface 32 can be shaped, curved, positioned and/or bent in a manner that enhances certain performance characteristics of the surface 32. For example, a connection between the surface 32 and the tube 24 can be used to create a bend in a flexible material (such as, for example, a polymeric film) such that the surface 32 generally has the form of a section of a half-cylinder around the light source 30 as shown in FIG. 2. While the surface 32 near or at its top edge 50 may have a substantially semi-circular or half-cylindrical curvature, the curvature of the surface 32, including the radius of curvature, may vary as the surface 32 extends into the interior of the tube 24. Variation in the curvature of the surface 32 may depend on, for example, the amount of flex in the surface 32, the stiffness of the surface 32, the size of the surface 32, the shape of the surface 32, other factors, or a combination of factors. The surface 32 can be positioned near the light source 30 as shown in FIG. 9 and surround the light source as shown in FIG. 2. The surface 32 can also be positioned such that the light fixture is substantially symmetrical about a vertical plane of symmetry. In some embodiments, the tabs 66*a*-66*c* shown in FIG. 10 are inserted into corresponding slots or openings (not shown) in the wall of the tube 24, with friction, an adhesive, or another type of connection holding the position and curvature of the surface 32 substantially fixed with respect to the tube 24. The surface 32 can be any suitable shape, including, for example, the shape shown in FIG. 10. In certain embodiments, the surface 32 has a curved top edge 50 that conforms substantially to the tube 24 and a base perimeter 52 that assumes a substantially planar arch when the surface 32 is installed in the tube 24. In some embodiments, the plane in which the base perimeter 52 exists is substantially perpendicular to the sidewall of the tube 24.

In some embodiments, the prismatic film 132 illustrated in FIG. 3 can be similar to the light control surface 32 described above, except as further described herein. The film 132 is positioned above and around the light source 30. The light control film 132 can be configured to reflect light from the light source 30 downward and minimize the loss of sunlight transported down the tube 24. The configuration of the light control film 132 can encompass one or more of the shape, position, orientation, and curvature of the film 132.

The top face 135 can include turning microstructure that comprises angular prisms that extend the effective length of the film 132. The vertices of the prisms can extend in a direction generally perpendicular to the direction of curvature of the film 132 (e.g., the prisms are substantially linear when the film 132 has one radius of curvature). The sizes of the microstructure and film are exaggerated in the figures to show detail. The bottom face 134 of the film 132 is substantially smooth. In some embodiments, the prismatic film 132 is constructed from a polymeric film such as, for example, 2301 Optical Lighting Film, available from the 3M Company of St. Paul, Minn. An upper edge of the top face 135 can generally slant or taper downwardly, as shown, in the direction away from the top edge 50. In some embodiments, this slanting or tapering can provide increased coverage area around the light source 30 and/or improved downward reflection of the light emitted from the light source 30.

The prismatic film 132 will now be discussed with reference to FIGS. 4-6. Light ($L_A$) from the auxiliary light source 30 undergoes total internal reflection (TIR) when it passes obliquely from a high index medium to a low index medium. In these examples, the high index medium is the prismatic film 132, and the low index medium is air. TIR occurs only at certain angles of incidence bounded by an incident angle called the critical angle 142. Any angle of incidence exceeding the critical angle will cause the incident light to reflect off the interface surface. The reflected angle will be equal to the initial angle of incidence. This critical angle 142 ($\theta_{Cr}$) can be determined for a material interfacing with air using the following formula:

$$(\theta_{Cr})=\sin^{-1}(1/n),$$

where n is the refractive index of the material.

Table A shows examples of critical angles for various transparent materials.

TABLE A

| Material | Refractive Index | Critical Angle |
|---|---|---|
| Teflon | 1.35 | 47.8° |
| Acrylic | 1.49 | 42.2° |
| Glass | 1.52 | 41.1° |
| Polycarbonate | 1.58 | 39.3° |

The prismatic film 132 that exhibits TIR will now be discussed with reference to FIGS. 4-6. Many microscopic 90-degree included angle prisms are molded into the top surface 135 of the film 132. The included angle 140 between the surfaces 136, 138 of a prism is approximately 90 degrees, while the angle between prisms may be slightly greater than the included angle when the film 132 is curved in the manner shown. The bottom surface 134 of the film is substantially planar or non-structured. Light ($L_A$) that is directed normal to the planar surface 134 reflects off both prism surfaces 136, 138 and reflects back in the direction it came from (for example, not accounting for the third dimension) if the incident angle to the prism surface 136 is greater than the critical angle 142 for the respective material. Because it reflects off both surfaces 136, 138 of the prism, there is a limited range of incident angles 144 that will result in total internal reflection, and the range of incident angles 144 depends on the refractive index of the material. Acrylic, with a critical angle of 42.2 degrees, will TIR light within approximately +/−3 degrees of the normal to the planar surface 134 of the film 132. A higher index material offers a greater range of angles 144 due to the lower critical angle 142. For polycarbonate, the range of angles 144 from normal through which TIR occurs is approximately +/−6 degrees. Thus, higher index materials can provide a greater range of incident angles for TIR to occur.

Daylight ($L_S$) passing through the prismatic side 135 of the film 132 will primarily incur transmission losses due to reflections from the surfaces 134, 135 of the film. In some embodiments, the fraction of light lost due to surface reflections is about 8-10%. Most daylight passes through the film 132 and propagates down the tube 24 to the diffuser 26. When a larger-sized film 132 is used, a greater proportion of daylight $L_S$ propagating down the tube 24 is incident on the film 132. Surface reflections are correspondingly greater. In general, a smaller proportion of daylight $L_S$ is incident on the film when a film 132 of smaller size is used.

In some embodiments, the prismatic film 132 is flexible and can easily be formed into a variety of shapes. The shape of the film 132 can be selected to increase or maximize the ability of the film 132 to reflect light from the light source 30 towards the diffuser 26. The film 132 can be curved in such a manner that the prisms face out (e.g., on the top surface 135 of the film 132) and the planar side faces in (e.g., on the bottom surface 134 of the film 132). The prisms can extend the length of the film 132. The film 132 can positioned such that, if a single point source of light is placed at the radius point (e.g., the center point of the diameter) of the film, substantially all of the light rays that strike the prismatic film will be normal or nearly normal to the planar surface 134 and will TIR off the prisms on the top surface 135.

A light source 30 having many points of light over its surface, such as, for example, a surface-mount LED, can be used instead of a single point source. Each point in such a light source 30 can have a different path to the film 132. If the light ray is outside of the incident angle range 144 that results in TIR, the light can pass through the film 132 and can be lost up the tube 24. Increasing the diameter 158 of the curved film 132 can reduce the range of incident angles at the film 132 that result from a multi-point source and increase the amount of light that is reflected. Therefore, positioning a curved TIR prismatic film 132 with the radius point at the base of the light source 30 can reflect most light emanating from the light source 30 downward towards the diffuser 26.

Figure 7:
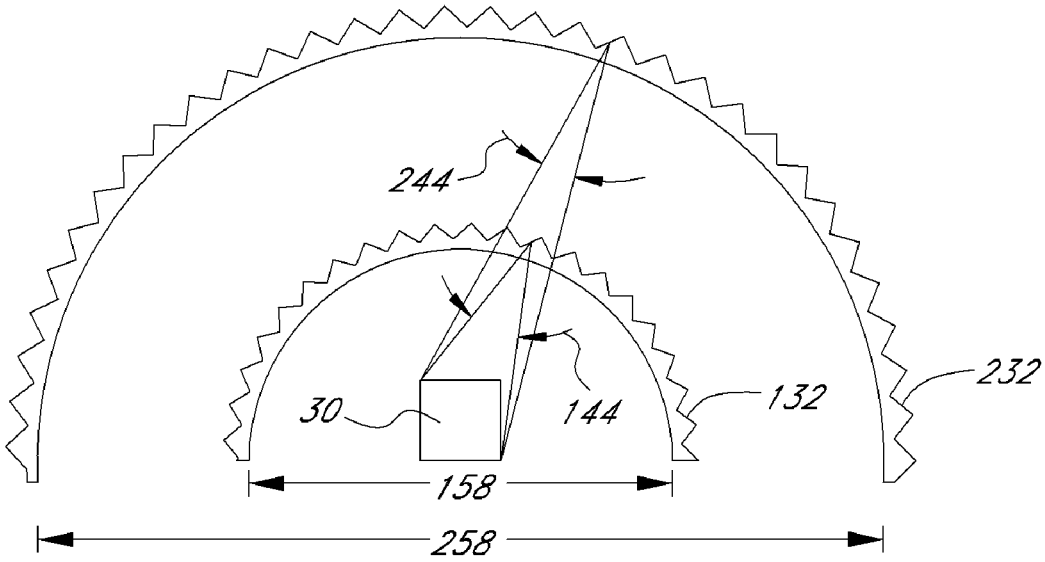
FIG. 7 is a cross-sectional view of prismatic films having different diameters.

Examples of prismatic films having different diameters are illustrated in FIG. 7. A first film 132 having a first diameter 158 is shown. The radius point of the curved film 132 is halfway along the bottom edge of the light source 30. In order for the film 132 to reflect substantially all of the light emanating from the light source 30, the film 132 can be configured to reflect incident light at least at the range 144 of incident angles shown. A second film 232 having a second diameter 258 larger than the first diameter 158 of the first film 132 is also shown. In order for the second film 232 to reflect substantially all of the light emanating from the light source 30, the film 232 can be configured to reflect incident light at least at the second range 244 of incident angles shown. The range 244 of angles for the second film 232 can be narrower than the range of angles 144 for the first film 132. The film 132 of smaller diameter 158 can reflect a greater range of incident light when compared to the film 232 of greater diameter 258. The shape, composition, position, curvature, and size of a prismatic film can be selected to balance improvements in the proportion of light reflected by the surface against the proportion of daylight that is lost due to surface reflections from the film. For example, when a prismatic film with a lower refractive index is used, a larger diameter can be selected to increase reflection of light. A smaller diameter can be selected when a high index film material is used. In certain embodiments, the prismatic film includes a combination of materials having different refractive indices. In certain such embodiments, the prismatic surface of the film can be constructed from a relatively high index material.

Figure 8:
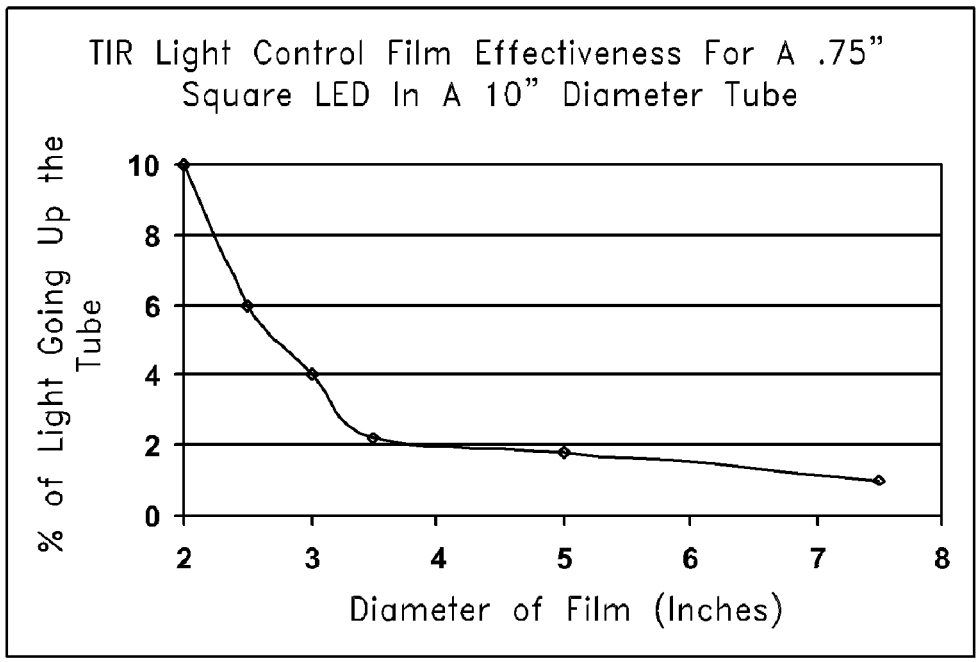
FIG. 8 is a sample graph showing an example of a relationship between the diameter of a prismatic film and the proportion of auxiliary light that travels up the tube.

The graph shown in FIG. 8 displays the results of an optical analysis of a polycarbonate prismatic film 132 positioned as shown in FIG. 3. Curved films of various diameters were tested in a TDD having a 10" diameter. A 0.75" by 0.75" LED having a light spread of 120 degrees was used as the light source 30. The performance of curved films of various diameters is shown by comparing the proportion of light going up the tube against the diameter of the film. The graph illustrates the relationship between incident angle to the prism and the critical angle tolerance. Using a film of greater diameter increases the distance from the light source 30 to the film 132, reduces the incident angle to the surface of the film 132, and can increase the proportion of light reflected towards the diffuser 26. When the proportion of light directed towards the diffuser 26 increases, the proportion of light going up the tube is decreased.

If a light control surface 32 were placed at a 90 degree angle to the light source 30—in other words, if the surface 32 were mounted perpendicular to the tube wall 24 and the angle from horizontal were zero—the surface 32 would generally need to extend across the entire tube to capture and redirect all light emanating from the light source 30. A surface 32 in this orientation would occupy a large portion of the tube's cross section. Referring now to FIG. 9, a cross-sectional view of a light control surface 32 and a light source 30 connected to the sidewall of a tube 24 is shown. Tilting the curved surface 32 down to an angle 66 at which the reflected light from the surface 32 generally does not reflect a significant amount of light back onto the light source 30 can reduce the amount of light control material required, reduce the distance that the surface 32 extends into the tube 24, and cause the light to be more vertically reflected down the tube. In some embodiments, the angle 66 between the surface 32 and horizontal is greater than or equal to about 20 degrees and/or less than or equal to about 45 degrees, or greater than or equal to about 10 degrees and/or less than or equal to about 30 degrees.

The tilt 66 from horizontal of the curved surface 32 can be selected based on, for example, the range of angles at which light is emitted from the light source 30, the size and shape of the tube 24, the size and shape of the light control surface 32, and the size and shape of the light source 30. For the illustrated example, the half angle spread of the light source 30 is 60 degrees. Thus, if the light control surface 32 were sloped down 30 degrees from horizontal, at least some of the light would be reflected back into the light source 30. In some embodiments, reducing the angle 66 to about 20 degrees can cause light to be reflected past the LED. Further, extending the base perimeter 52 of the lens to the same horizontal plane as the base of the light source 30 allows upwardly directed light to be captured and reflected down the tube 24.

At least some of the embodiments disclosed herein may provide one or more advantages over existing lighting systems. For example, certain embodiments effectively allow a TDD to increase or maximize the lighting potential from at least two light sources—daylight and an auxiliary light source. As another example, some embodiments provide techniques for directing light from at least two light sources in a way that decreases or minimizes wasted light. At least some of these benefits can be achieved at least in part by placing an auxiliary light source into a tubular skylight without substantially obscuring daylight propagating down the tube. At least some of these benefits can be achieved at least in part by using a light control surface that transmits daylight while capturing the upwardly propagating light from an auxiliary light source. At least some of these benefits can be achieved at least in part by shaping and tilting the light control surface in relation to the light source.

Certain embodiments may provide additional benefits, including reducing the incident angle at the diffuser of light propagating from the auxiliary light source, which can result in the diffuser operating with higher optical efficiency.

Another benefit can include extra spreading of the light reflected from the light control surface when compared to direct light from a light source (for example, from a light source facing down the tube towards the diffuser).

Discussion of the various embodiments disclosed herein has generally followed the embodiments illustrated in the figures. However, it is contemplated that the particular features, structures, or characteristics of any embodiments discussed herein may be combined in any suitable manner in one or more separate embodiments not expressly illustrated or described. For example, it is understood that an auxiliary light fixture can include multiple light sources, lamps, and/or light control surfaces. It is further understood that the auxiliary lighting fixtures disclosed herein may be used in at least some daylighting systems and/or other lighting installations besides TDDs.

It should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Moreover, any components, features, or steps illustrated and/or described in a particular embodiment herein can be applied to or used with any other embodiment(s). Thus, it is intended that the scope of the inventions herein disclosed should not be limited by the particular embodiments described above, but should be determined only by a fair reading of the claims that follow.

What is claimed is:

1. A daylighting apparatus comprising:

a tube having a sidewall with a reflective interior surface, the tube disposed between a transparent cover configured to receive daylight and a diffuser configured to be positioned inside a target area of a building, the tube configured to direct the daylight transmitted through the transparent cover towards the diffuser; and an auxiliary light fixture comprising a lamp configured to provide illumination to the interior of the tube by emitting a cone of light, the lamp positioned such that light exiting the lamp along the angular center of the cone of light propagates such that the light is incident on a surface other than the diffuser before propagating to the diffuser;

wherein the auxiliary light fixture further comprises a light control surface extending from the sidewall of the tube and configured to redirect at least a portion of light emanating from the lamp towards the diffuser;

wherein the light control surface comprises a reflector; and wherein the light control surface comprises a prismatic film configured to reflect the light exiting the lamp and to transmit daylight propagating through the tube from the direction of the transparent cover.

2. The daylighting apparatus of claim 1, wherein the lamp comprises a surface-mount light-emitting diode having a planar surface from which the cone of light is emitted.

3. The daylighting apparatus of claim 2, wherein the planar surface is substantially parallel to the sidewall of the tube.

4. The daylighting apparatus of claim 1, wherein the lamp is disposed on the sidewall of the tube.

5. The daylighting apparatus of claim 1, wherein the shape of the light control surface is substantially half-cylindrical.

6. A daylighting apparatus comprising:

a tube having a sidewall with a reflective interior surface, the tube disposed between a transparent cover configured to receive daylight and a diffuser configured to be positioned inside a target area of a building, the tube configured to direct the daylight transmitted through the transparent cover towards the diffuser; and an auxiliary light fixture comprising a lamp configured to provide illumination to the interior of the tube by emitting a cone of light, the lamp positioned such that light exiting the lamp along the angular center of the cone of light propagates such that the light is incident on a surface other than the diffuser before propagating to the diffuser;

wherein the auxiliary light fixture further comprises a light control surface extending from the sidewall of the tube and configured to redirect at least a portion of light emanating from the lamp towards the diffuser;

wherein the shape of the light control surface is substantially half-cylindrical; and wherein the light control surface comprises a top edge and a base perimeter, the top edge abutting the sidewall of the tube and the base perimeter being substantially coplanar with a base of the lamp.

7. A daylighting apparatus comprising:

a tube having a sidewall with a reflective interior surface, the tube disposed between a transparent cover configured to receive daylight and a diffuser configured to be positioned inside a target area of a building, the tube configured to direct the daylight transmitted through the transparent cover towards the diffuser; and an auxiliary light fixture comprising a lamp configured to provide illumination to the interior of the tube by emitting a cone of light, the lamp positioned such that light exiting the lamp along the angular center of the cone of light propagates such that the light is incident on a surface other than the diffuser before propagating to the diffuser;

wherein the auxiliary light fixture further comprises a light control surface extending from the sidewall of the tube and configured to redirect at least a portion of light emanating from the lamp towards the diffuser;

wherein the shape of the light control surface is substantially half-cylindrical, and wherein the light control surface is positioned such that a radius point of the light control surface is approximately at a base of the lamp.

8. The daylighting apparatus of claim 7, wherein the light control surface comprises a reflector.

9. The daylighting apparatus of claim 7, wherein the light control surface is tilted at an angle away from a perpendicular orientation with respect to the sidewall.

10. The daylighting apparatus of claim 9, wherein the angle between the light control surface and the perpendicular orientation is at least about 20 degrees.

11. A daylighting apparatus comprising:

a tube having a sidewall with a reflective interior surface, the tube disposed between a transparent cover positioned to receive daylight and a diffuser, the tube configured to direct the daylight transmitted through the transparent cover towards the diffuser; and an auxiliary light fixture comprising:

a lamp disposed to direct light within the tube; and a light control surface configured to reflect light exiting the lamp towards the diffuser and to transmit daylight propagating through the tube from the direction of the transparent cover;

wherein the lamp comprises a light-emitting diode, wherein the auxiliary light fixture comprises at least a second light-emitting diode, and wherein the auxiliary light fixture comprises at least a second light control surface.

12. The daylighting apparatus of claim 11, wherein the lamp is connected to the sidewall of the tube.

13. A daylighting apparatus comprising:

a tube having a sidewall with a reflective interior surface, the tube disposed between a transparent cover positioned to receive daylight and a diffuser, the tube configured to direct the daylight transmitted through the transparent cover towards the diffuser; and an auxiliary light fixture comprising:

a lamp disposed to direct light within the tube; and a light control surface configured to reflect light exiting the lamp towards the diffuser and to transmit daylight propagating through the tube from the direction of the transparent cover;

wherein the lamp is connected to the sidewall of the tube; and wherein thermal grease is disposed between the lamp and the sidewall.

14. A daylighting apparatus comprising:

a tube having a sidewall with a reflective interior surface, the tube disposed between a transparent cover positioned to receive daylight and a diffuser, the tube configured to direct the daylight transmitted through the transparent cover towards the diffuser; and an auxiliary light fixture comprising:

a lamp disposed to direct light within the tube; and a light control surface configured to reflect light exiting the lamp towards the diffuser and to transmit daylight propagating through the tube from the direction of the transparent cover;

wherein a base perimeter of the light control surface is substantially coplanar with a lower edge of the lamp.

15. The daylighting apparatus of claim 13, wherein the lamp comprises a light-emitting diode.

16. The daylighting apparatus of claim 15, wherein the auxiliary light fixture comprises at least a second light-emitting diode.

17. A daylighting apparatus comprising:

a tube having a sidewall with a reflective interior surface, the tube disposed between a transparent cover positioned to receive daylight and a diffuser, the tube configured to direct the daylight transmitted through the transparent cover towards the diffuser; and an auxiliary light fixture comprising:

a lamp disposed to direct light within the tube; and a light control surface configured to reflect light exiting the lamp towards the diffuser and to transmit daylight propagating through the tube from the direction of the transparent cover;

wherein the light control surface comprises a polycarbonate film.

18. A daylighting apparatus comprising:

a tube having a sidewall with a reflective interior surface, the tube disposed between a transparent cover positioned to receive daylight and a diffuser, the tube configured to direct the daylight transmitted through the transparent cover towards the diffuser; and an auxiliary light fixture comprising:

a lamp disposed to direct light within the tube; and a light control surface configured to reflect light exiting the lamp towards the diffuser and to transmit daylight propagating through the tube from the direction of the transparent cover;

wherein the light control surface comprises turning microstructure disposed on a side of the surface closest to the transparent cover.

19. The daylighting apparatus of claim 18, wherein the turning microstructure comprises a plurality of elongate prisms extending from the sidewall to a base perimeter of the light control surface.

* * * * *